United States Patent [19]

Shenker

[11] 3,995,983

[45] Dec. 7, 1976

[54] WHEEL FOR WORKING ON CERAMICS, PLASTICS OR STONE

[76] Inventor: Martin S. Shenker, 7700 Cindy Lane, West Bethesda, Md. 20034

[22] Filed: July 15, 1975

[21] Appl. No.: 596,179

[52] U.S. Cl. ..... 425/459; 425/263

[51] Int. Cl.[2] ..... B28B 1/02; B28B 1/28

[58] Field of Search ..... 425/86, 87, 181, 459, 425/463, 468, 263–268; 274/39 A; 74/572, 573, 574; 192/66, 84 C

[56] References Cited

UNITED STATES PATENTS

| | | | |
|---|---|---|---|
| 2,282,071 | 5/1942 | Marsac | 74/572 X |
| 2,638,653 | 5/1953 | Adams | 425/459 X |
| 2,722,846 | 11/1955 | McDonald | 192/84 C X |
| 2,902,741 | 9/1959 | Hankin | 425/459 |
| 3,104,337 | 9/1963 | Gindroz | 192/66 X |
| 3,520,036 | 7/1970 | Maloney | 425/264 X |
| 3,605,218 | 9/1971 | Rasmussen | 425/459 |
| 3,796,105 | 3/1974 | Menard | 425/86 X |
| 3,894,830 | 7/1975 | Edwards | 425/459 |

FOREIGN PATENTS OR APPLICATIONS

| | | | |
|---|---|---|---|
| 1,223,108 | 2/1971 | United Kingdom | 425/459 |
| 650,285 | 2/1951 | United Kingdom | 425/263 |

*Primary Examiner*—Ronald J. Shore
*Assistant Examiner*—John S. Brown

[57] ABSTRACT

A device for use in making hand formed pottery which includes an electric motor having a high speed flywheel connected to said motor and coupled through a speed reduction system to a slow turning table for working of the clay with the added provision of electric braking.

3 Claims, 4 Drawing Figures

WHEEL FOR WORKING ON CERAMICS, PLASTICS OR STONE

This invention relates to turning and forming devices which are involved when working with wood, metal, plastics, and especially with clay.

In potters' wheels, it is desirable for the worker to vary the speed of rotation of the wheel by using an electric motor because of its ease of operation and portability. Prior art attempts have provided voltage control means adjustable by the worker as in British Pat. No. 1,223,108; variable speed drive mechanism as in U.S. Pat. No. 2,638,653 and variable speed power drive and change of speed gears connected to the power shaft as in U.S. Pat. No. 2,554,838.

In each of these instances, the drive mechanism maintains a set speed until the operator consciously changes it, rather than decreasing the speed gradually as in the traditional kicked flywheel used for the potters' wheel.

The present invention produces a potters' wheel that allows for a simpler, lighter construction with portability, if desired, and eliminates the prior art complex variable speed motors with their complex electronics.

This invention closely simulates the original kicked flywheel with the 1 to 1 ratio that has been in use for centuries. However, the flywheel of this invention turns at a higher speed than the turntable and can store up the same energy as would be present in the prior art devices that use a 1:1 kicked flywheel. This higher speed flywheel spins at a rate that is 5 to 30 times faster than the turntable. Thus, using this smaller high speed flywheel results in the production of a lighter smaller and more portable potters' wheel.

The kicking is accomplished by the motor because the flywheel is mounted directly over the motor. Optionally, an over-running clutch-bearing can be used for this purpose. The speed reduction is accomplished with any convenient means such as belt reduction, traction drive, gear drive, differential drive, epicyclic drive, harmonic drive or any smooth mechanical speed reduction system.

A form of this invention is now described by way of example only with reference to the accompanying drawing.

Figure 1:
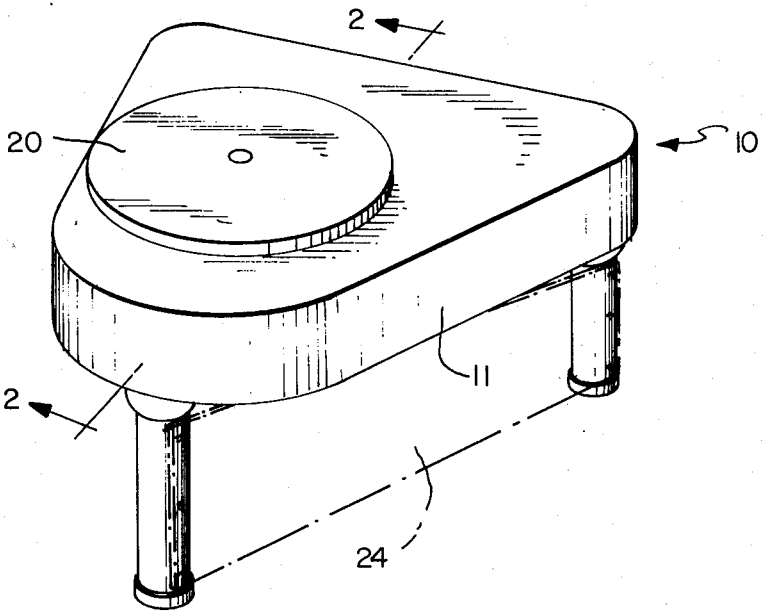
FIG. 1 is a plan view of the device in compact form.
Figure 2:
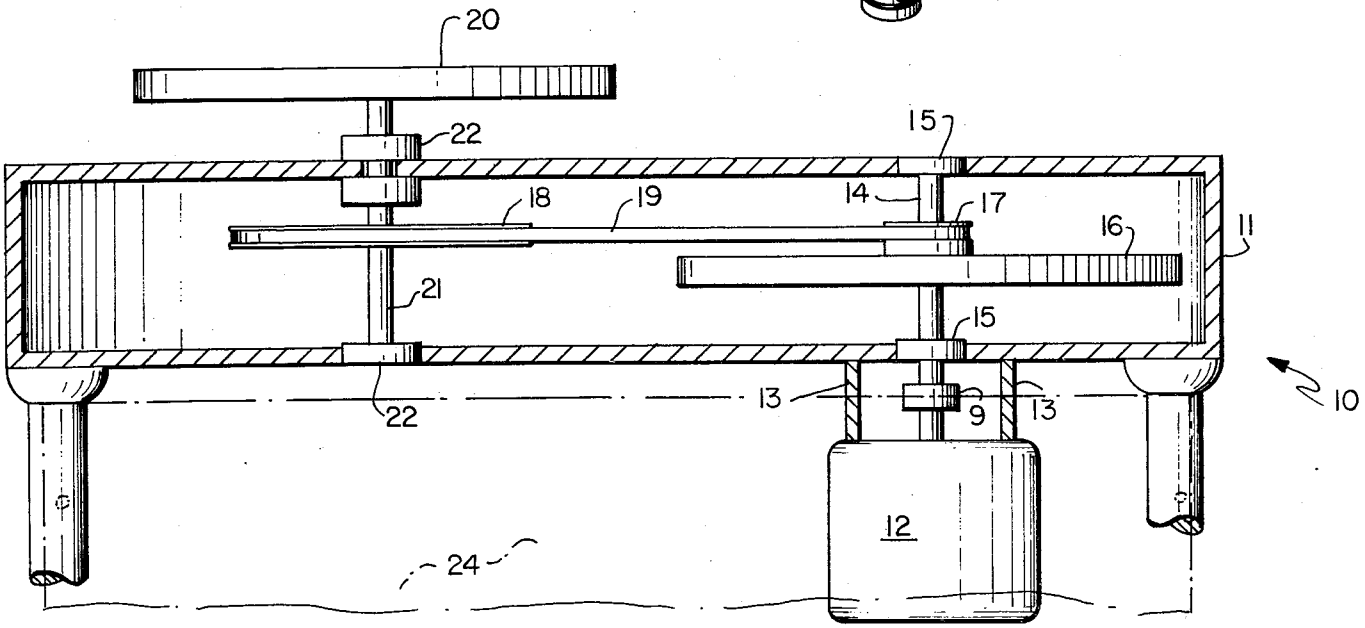
FIG. 2 is a vertical cross-section 2—2 of FIG. 1 showing the cooperative mechanism of the device.
Figure 3A:
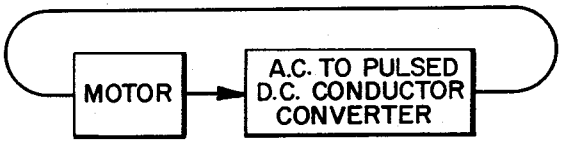
Figure 3B:
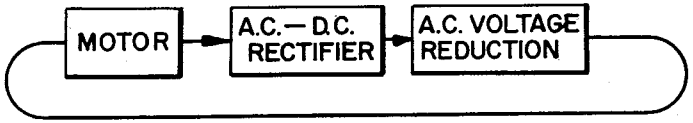

FIGS. 3*a* and 3*b* are block diagrams of an electronic braking means.

The device 10 includes a leg supported compartment 11 to which motor 12 is mounted by support posts 13. This motor has a speed of at least 1500 rpm. A flexible coupling or clutch 9 is provided to connect drive shaft 14 to flywheel 16 with the provision of bearings 15. A speed reduction means is provided with belt 19 connected over small pulley 17 and large pulley 18 to turntable 20 on drive shaft 21 mounted with bearings 22.

In operation, an electric switch is depressed by the operator to turn on the motor. The flywheel accelerates to the speed desired by the user. Its speed can be controlled by use of the speed reduction mechanism, thereby increasing its torque to the throwing head used by the potter in forming a clay pot. When the current is turned off, the flywheel slows down. As the potter works the clay, the flywheel energy will be released and cause it to more quickly slow down. If more speed of the turntable is desired, the operator again depresses the electric switch which turns on the motor which introduces additional energy into the flywheel resulting in a speeding up of the turntable. If less speed is desired, then the operator can simply activate an electronic or electrical braking means that is provided with the motor.

In FIGS. 3*a* and 3*b*, there are shown block diagrams of 2 circuits which include an A.C. to D.C. converter which may consist of a voltage reduction and rectification system or of a pulsed D.C. system using thyristors and diodes. There are a number of such proprietary solid state circuits commercially available.

Existing potters' wheels use a 1 to 1 ratio flywheel coupled directly to the head. However, in applicant'S potters' wheel, a high speed flywheel runs at 7 to 30 times faster than the turntable. Since the energy stored in the flywheel varies as the square of its speed, a much smaller flywheel can be used than those in the prior art. The energy formula is $$E = \frac{\text{Wt. } V^2}{2g}$$

(in ft. lbs.)

wherein Wt. is the weight of the flywheel rim, V is velocity at average radius in ft./sec. and $2g \approx 64.3$.

The potter controls the speed of the turntable by simply depressing a foot or hand switch and turning the motor on or off, repetitively, as required. A steady speed under load can be accomplished by pulsing the switch which turns the motor on or off in rapid succession until the right amount of power is added to the flywheel. Braking is accomplished electrically by using the motor connected to suitable electronic controls. For example, when using an A.C. motor and braking is desired, a D.C. current is passed through the field of the motor which causes the motor to slow down. Alternately, with certain types of A.C. motors, a braking action is possible by reversing the motor, which will cause it to slow down, and then accelerate in the opposite direction of rotation. When using a D.C. motor, the armature leads are shorted while the field is left energized causing the motor to slow down. Other means of electric braking may also be employed.

The potters' wheel of this invention has the advantages of light weight and portability. Its simple design allows for low cost construction. Thus, very powerful wheels can be constructed using relatively low horsepower motors. It is possible to eliminate brush type motors, or ones with mechanical starting switches. Furthermore, complex variable drives, either electronic or mechanical, are also avoided.

In use, protection of the operator is provided by a snap-on type face sheet of plastic or metal 24 positioned between the front legs facing the operator.

What is claimed is:

1. A potter's wheel comprising a large pulley attached on the shaft of the turntable connected by a speed reduction means which includes a belt surrounding a smaller pulley which is located on the shaft of a subtended electric motor and a flywheel located on said same shaft and including an electronic or electrical braking means selectively controllable to said motor.

2. The device of claim 1 wherein a clutch is coupled to the flywheel shaft.

3. The device of claim 1 wherein a light weight high speed A.C. electric motor is used and is controlled by activating an opposing D.C. electronic current.

* * * * *